US006467771B1

(12) United States Patent
deKeller

(10) Patent No.: US 6,467,771 B1
(45) **Date of Patent: *Oct. 22, 2002**

(54) CASINO GAME AND DEVICE THEREFOR

(76) Inventor: David deKeller, Sweet Valley Farm, Cape Town (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 09/692,410

(22) Filed: Oct. 18, 2000

Related U.S. Application Data

(63) Continuation-in-part of application No. 09/159,400, filed on Sep. 23, 1998, now Pat. No. 6,379,245, which is a continuation-in-part of application No. 08/526,382, filed on Sep. 11, 1995, now Pat. No. 5,975,529.

(51) Int. Cl.[7] ..... A63F 3/00
(52) U.S. Cl. ..... 273/274; 273/292; 463/13
(58) Field of Search ..... 273/277, 292, 273/303; 463/11–13

(56) References Cited

U.S. PATENT DOCUMENTS 5,224,706 A * 7/1993 Bridgeman et al. ..... 273/292
5,314,194 A * 5/1994 Wolf ..... 273/274
5,580,061 A * 12/1996 Kong ..... 273/292
5,725,215 A * 3/1998 Hesse ..... 273/274
5,810,354 A * 9/1998 Banyai ..... 273/274
5,810,663 A * 9/1998 Bochichio et al. ..... 273/292
5,851,011 A * 12/1998 Lott ..... 273/292
5,997,002 A * 12/1999 Goldman ..... 273/292
6,007,424 A * 12/1999 Evers et al. ..... 273/292
6,102,402 A * 8/2000 Scott et al. ..... 273/274
6,179,711 B1 * 1/2001 Yoseloff ..... 273/138.1

* cited by examiner

*Primary Examiner*—Benjamin H. Layno
*Assistant Examiner*—V K Mendiratta
(74) *Attorney, Agent, or Firm*—Philip J. Anderson; Anderson & Morishita, LLC

(57) ABSTRACT

A method for playing a casino game is set forth wherein, in a table game format, players make a pot and an outcome wager. Each player is dealt a plurality of cards and a plurality of cards, some face up and some face down, some dealt as community cards. Players are given the option of increasing their outcome wagers and raising the pot during play. The pot won by the player with the highest ranking hand and outcome wager(s) are won based upon a schedule of winning outcomes. For an electronic version, the method includes the player making wagers as indicia are revealed and given the opportunity of holding or discarding indicia during play. In certain embodiments, the casino wins at least a portion of the pot based upon either certain community or non-dealt card combinations thus foregoing exacting a levy.

10 Claims, 1 Drawing Sheet

CASINO GAME AND DEVICE THEREFOR

"CROSS-REFERENCE TO RELATED APPLICATIONS

This application is a continuation-in-part application of application Ser. No. 09/159,400 filed Sep. 23, 1998 titled "Casino Method and Device Therefor" now U.S. Pat. No. 6,379,245 which is a continuation-in-part application by applicant herein of application Ser. No. 08/526,382 filed Sep. 11, 1995 and titled "Casino Poker Game" now U.S. Pat. No. 5,975,529."

FIELD OF THE INVENTION

The present invention relates to methods for playing a casino game in the nature of poker using one or more decks of conventional playing cards.

BACKGROUND OF THE INVENTION

Poker is a popular game throughout the world. It combines principles of card games known for centuries in Europe but in its present form it is distinctly of American origin. There are numerous forms of Poker and the main divisions are: Draw Poker, in which all of a player's cards are unknown to his opponents and Stud Poker, in which some of the player's cards are face up and others face down. Within the above two broad categories numerous variations exist with "Holdem" or "Texas Holdem" being a popular example. In "Holdem" each player makes an ante wager and is dealt two cards face down. After a betting interval three communal cards are dealt face up. A second betting interval follows and the dealer then turns up the fourth communal card. Another betting round follows after which the dealer turns up the final communal card and a final betting round occurs and the player with the highest Poker ranked hand assembled from their own cards and the five communal cards wins the pot.

In modern casinos the game of Poker takes one of three forms: live or cardroom Poker where players compete against one another but the games are controlled and supervised by a house dealer who removes a house levy either in the form of a participation fee or as a percentage of winning hands; electronic video machines offering various forms of Poker; and Poker played as a "bankers game" either where the game involves players in contest with the dealer's hand or where the object is for the players to obtain a hand based on hierarchical Poker rankings. In both versions of Banker games the house enjoys a favorable advantage based on a paytable that is structured in such a way that the pay-offs are not based on the true mathematical odds, or rules of play so structured that the house has a favorable edge.

The growth in casinos has prompted the introduction of new games and variations to established games. Numerous patents have been granted in this particular field. For example, in U.S. Pat. Nos. 4,836,553 and 4,948,134 (Suttle et al.) a casino type Poker game is disclosed in which players each play against a dealer (a banked game). If a player wins, he receives a bonus payment depending on the Poker rank of his hand. Various patents disclose casino type games where for example a standard deck is modified, for example, U.S. Pat. No. 5,423,551 (Stravinsky) where cards are dealt from two standard decks of fifty two cards plus eighteen special cards; U.S. Pat. No. 5,540,444 (Nguyen) discloses a deck of cards consisting of thirty two cards; U.S. Pat. No. 5,397,128 (Hesse et al.) discloses a casino game where cards are assigned certain values and the object is to hit a total 9 in total count or value.

Various other patents disclose further variations to traditional forms of Poker. Sklansky U.S. Pat. No. 5,382,025 discloses a modification of Texas Holdem whereby players do not compete against one another and whereby players have the opportunity to select their two card hand from a plurality of hands dealt face-up. Breeding U.S. Pat. No. 5,417,430 discloses a Poker banker game in which the players place three bets at the outset but as the game unfolds the players are given the option of withdrawing two of their wagers. Potter et al U.S. Pat No. 5,494,295 disclose an invention which provides a method whereby a plurality of hand ranking rules can be utilized within a single type wagering game.

It is to be noted that Poker in casinos (excluding video style machines) takes two distinct forms and method of operation; cardroom Poker where players compete against one another and banking type Poker games where players do not compete against one another but against the house either in terms of competing with a dealer or where there is no dealer hand and the object is to reach certain winning combinations.

With reference to some popular Poker game variations, there are known Poker game variations such as Caribbean Stud and Let It Ride where players try to obtain a hand which results in a pay off based upon a predetermined schedule of winning hands as well, for at least Caribbean Stud, as against the dealer. While these game appeal to novice and occasional players, it is believed that such games do not appeal to serious card room players. Serious players prefer games such as Texas Hold'em, Omaha, and Stud Poker, e.g. 7-card Stud where players play against one another to win a pot.

There is a need for a game method where players both compete against one another to win an assembled pot and against the house, e.g. to obtain a hand winning hand as determined by a predetermined schedule of winning hands and where they have the opportunity to receive bonus payments by achieving certain winning Poker hands/combinations.

With reference to electronic, video casino games the prior art discloses a number of Poker type games. Video Draw Poker is the most widely played of such games. In Video Draw Poker, a player places a wager of 1–5 units and a hand of five cards composed of electronically produced visual representation are displayed on a monitor. The player has the option of discarding some or all of the cards and receiving replacements which are selected by the machine's processor from memory. If the player's hand corresponds to one of the hands based on Poker ranking he wins the corresponding award displayed on the paytable. The award is multiplied by the number of units bet. Video Draw Poker appears in a progressive jackpot form—a player qualifies for the progressive jackpot provided he wagers the maximum number of units permissible (usually 5).

There is a need for an electronic Poker game which combines the aspects of card room Poker where players vie against one another to win a pot and where players also try to assemble a winning hand as determined by a predetermined schedule of winning hands to be paid by the house (casino).

SUMMARY OF THE INVENTION

There is therefor provided according to the present invention a device and method for playing a game which increases the opportunity for the player to increase their wagering during play, which provides the player with opportunities to win an aggregated pot and/or to obtain a pay off for assembling any one of a predetermined schedule of winning hands and which provides means for funding and awarding a jackpot. It is an object of the invention to provide a game which will appeal to cardroom Poker players. The method can be practiced in a live, table game format, over the Internet or by use of a device.

Accordingly, the method is provided for playing a casino game between a plurality of players using playing cards which includes each participating player making a pot wager and a first outcome or "ante" wager. All pot wagers made during the play of a hand or round of the game are aggregated to form a pot which is vied for by the participants of the hand. Cards are presented to each player or participant as by dealing seven cards to each player according to any one of the following grouped game dealing sequences, with betting intervals or rounds after each dealing sequence, 1. (a) 2 cards face up, one card face down to each player,
   (b) 3 community cards face up to be shared by all players, and
   (c) 1 card to each player face up,
2. (a) 2 cards face down, 1 card face up to each player,
   (b) 3 cards face up to each player, and
   (c) 1 card face down to each player,
3. (a) 2 cards face down, 1 card face up to each player,
   (b) 2 community cards face up to be shared by all players, and
   (c) 1 card face up, 1 card face down to each player, or
4. (a) 2 cards face down, 1 card face up to each player,
   (b) 2 cards face down to each player, and
   (c) 2 community cards, dealt one face up and one face down.
5. (a) 2 cards face down, 1 card face up to each player,
   (b) 2 cards face up to each player, and
   (c) 1 card face up, 1 card face down to each player, In all of the above examples a betting interval can occur between each dealing step. Regardless of the sequence of presentment, each player's final hand is determined by the highest ranking five card hand according to the rules of Poker.

During the sequences for presenting cards, each player has at least one opportunity to raise, i.e. increase, their pot wager. If any one player decided to raise, all other players must match (i.e. "See") the wagers to remain a participant for the pot. If a player decides not to see a raise wager, they are no longer a participant for the pot but remain a participant for a pay off. based upon the outcome of their hand. Multiple opportunities may be provided for players to raise their pot wagers during the dealing sequence.

After all hands have been presented, the rankings of the players hands are compared inter se and the player with the highest ranking final hand declared the winner of the pot. If two or more players tie for the highest ranking hand, the pot may be split equally among those players or carried over to the next hand. Before awarding the pot, according top one embodiment of the game where the game is hosted by a casino, the casino exacts a levy on the pot to provide a profit for hosting the game. According to another embodiment, the casino participates as a player and any profit to the casino is obtained by the casino winning pots.

In addition to awarding the pot based upon comparing the ranking of player's hands inter se, the ranking of each player's final hand is compared to a pre-established schedule of winning hands and if the player has a winning hand ranking, the casino or host paying the player. If the player does not have a winning hand, the player's outcome wager is lost. A schedule of winning hands may be as below:

TABLE 1

| | |
|---|---|
| Royal Flush | 250 to 1 |
| Straight Flush | 100 to 1 |
| 4-Of-A-Kind | 25 to 1 |
| Full House | 9 to 1 |
| Flush | 7 to 1 |
| Straight | 5 to 1 |
| 3-Of-A-Kind | 3 to 1 |
| Two Pair | 2 to 1 |
| Jacks or better | Push |

The game may also provide for a jackpot funded by a levy on the pot. The jackpot or portions thereof may be awarded based upon the ranking of a player's hand, e.g. a Royal Flush, or based upon a bad beat or big beat outcome. A bad beat is where a player has a high ranking hand, e.g. full house, and loses to a player with a higher ranker hand, e.g. a four-of-a-kind. A big beat jackpot, according to the present invention is a condition where a player has the highest ranking hand and another player having a predetermined hand combination. In a condition of a bad beat or a big beat, the player with the bad beat losing outcome or big beat winning outcome, is awarded a portion of the progressive jackpot with the other player receiving another, lesser portion. Other players at the table or participating on the hand may also receive an award.

DESCRIPTION

Figure 1:
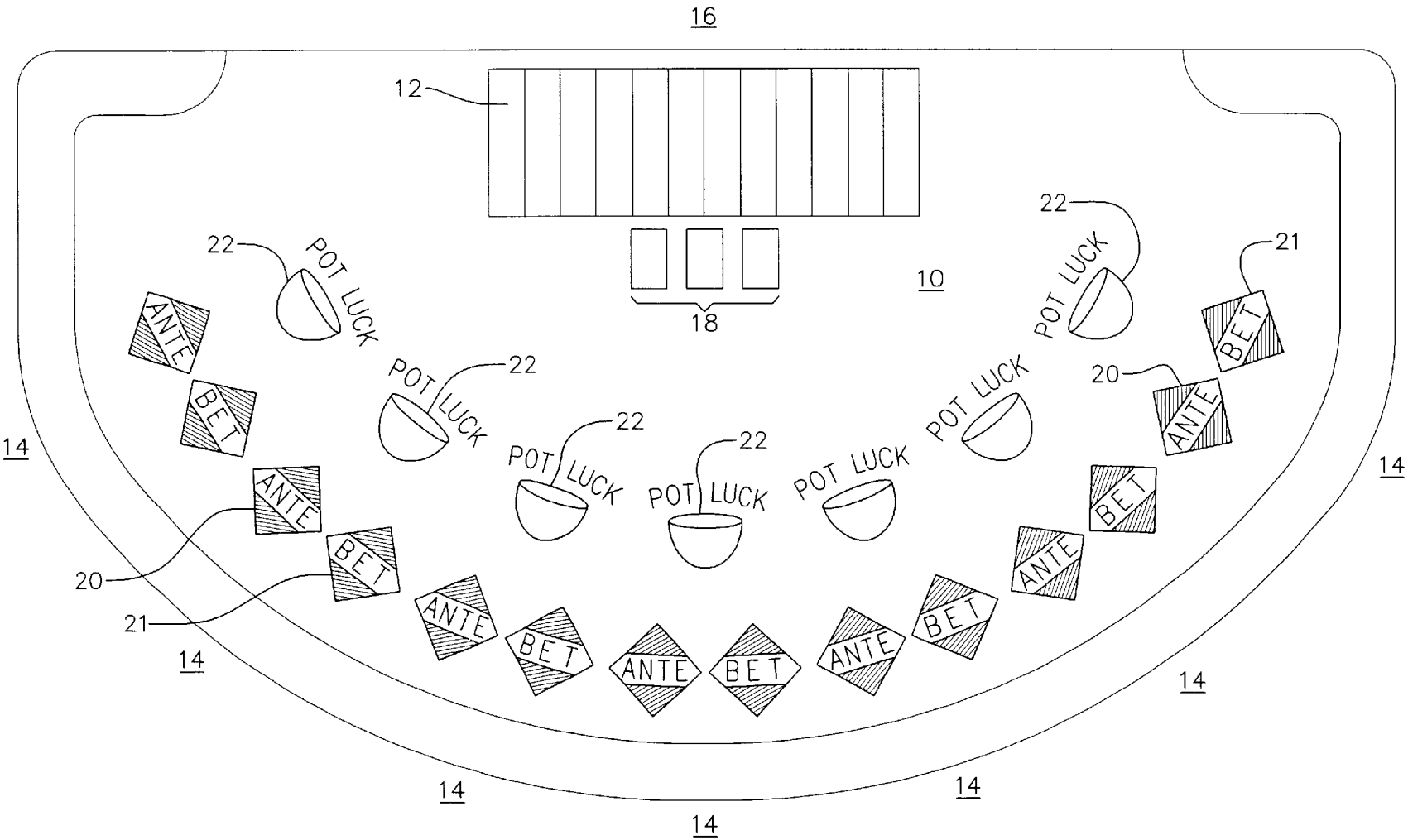
FIG. 1 shows a layout for playing various embodiments of the games according to the present invention where community cards are used.

In a preferred embodiment of the table game version of the present invention a gaming layout 10 is provided having a surface as illustrated in FIG. 1 for playing the game using, preferably, a single deck of standard playing cards. The method employs the same basic priority or ranking of five card hands according to the rules of Poker familiar to players and as set forth in Table 2.

TABLE 2

| |
|---|
| Royal Flush |
| Straight Flush |
| Four-of-a-Kind |
| Full House |
| Flush |
| Straight |
| 3-of-a-Kind |
| Two Pair |
| One Pair |
| High Card(s) |

Referring to FIG. 1 the layout 10 (semi-circular) again a configuration familiar to players. A rack 12 is provided for housing the chips/checks used during play of the game of the method. The layout 10 has locations 14 for the players and a location 16 for the dealer. Between the dealer and player locations 16, 14 is an area 18 marked to define the areas wherein the community cards, according to one embodiment of the game, are positioned by the dealer during play of the game. The area 18 which designates the position of the dealer's/community cards can be denoted to position from two to five community cards or with no markings for community cards for those embodiments where no community cards are used.

Each player location 14 has associated therewith an ante wager area 20 and a bet area 21 for the reception of players' wagers during play of the game. The ante wager areas 20 may be denoted by symbols situated in front of each player as may each bet area 21. Also provided at each player position 14 is a pot wager area 22 which may be denoted by lettering, a casino logo or a stylized pot as shown in FIG. 1.

As described below, the ante wagers made by the players are directed to a paytable ranking of the final hand assembled by the player during play. The pot areas 22 are directed to pot wagers as hereinafter described. The pot wagers are aggregated into a pot to be vied for between the players.

In the method of the game of the present invention, the objects of the method are twofold:

1) to make a Poker hand, using individual cards and the community cards (if provided), which corresponds to a predetermined paytable of hands, and;
2) to win the pot and any raise wagers at the table by assembling the highest ranking Poker hand among all the players at the table vying therefor.

In the case of the first object, the house payment schedule, or paytable, lists a series of Poker hands with corresponding pay-offs. These payoffs correspond to the ante and to the optional "bet" wager, equal in value to the ante wager made by the player. The players make their ante (outcome) wager prior to receiving their initial cards. In one embodiment of the method of the invention the ante wager is optional, in another embodiment, the ante wager is mandatory. Having examined their first three cards in the various versions of the method, the players have the option of doubling down (i.e. doubling) their ante wager. Thus, with respect to the ante wager and any double down wagers, as hereinafter described, the player is playing against the house by trying to obtain a final hand which corresponds to one of the hands listed in the established paytable.

In the case of the second object and with respect to the pot wager (and any raise wagers added to the pot), the player with the highest Poker hand showing wins the pot and raise wagers. The pot and raise wagers is a bet solely between the players (and a designated house player, or dealer, as provided according to one embodiment of the game) as to who will have the winning, highest ranked, hand among the participants.

The Method Of Play

At the start of each game and prior to receiving cards all players make their outcome ("ante") wager by placing their bet in area 20. Each player also places a first pot wager in betting area 22. The ante wager may be mandatory or optional and the amounts of both initial wagers may be dictated by house minimums and maximums. In one embodiment of the method, the pot cannot be raised, in a second embodiment of the game the option exists to raise the pot at each established betting interval and in a third embodiment multiple pot raises can be made at each betting interval.

In the live game version, the dealer shuffles the cards and deals cards to each player (and community cards if provided therefor) according to any one of the following, predetermined schedules of grouped dealing sequences.

Sequence 1

According to this version of the game, three cards are dealt to each player, two cards face up, and one card face down. At this point the player has the option of increasing ("raising") their pot wager based upon the three cards dealt. In addition the players have the option of doubling down (increasing) their ante wager in the area 21 on the layout 10 provided such increase is equal in value to their original ante wager. Any pot raises are placed in area 22 on the layout 10. If any one player raises the pot, all other players must match ("see") the raise or be eliminated as a participant for the pot aspect of the game. After all players have exercised their option to raise, see or decline raising, the dealer deals thee community cards face up in area 18 players have the option to once again raise the pot wager. The dealer then deals a final card to each player face down and the players have the option of a final raise of the pot wager.

Thereafter, the players reveal their cards for resolution of the wagers. As to the pot and any raise wagers, the accumulated pot wagers and any raise wagers is won by the player at the table with the highest ranking, five card hand which can be assembled from the seven card hand consisting of the player's four cards and the community cards which are shared by which all players. Thus, each player uses the three community cards in area 18 with their three cards to have a seven card hand from which the player forms the highest ranking five card Poker hand. Those players who declined to see any raise wagers are excluded from winning the pot aspect of the game.

In awarding the pot to the winning player, the casino hosting the game and providing the dealer, may exact a levy on the pot to provide a profit to the casino for hosting the game. The levy may be, for example 5% of each pot.

Further, if two or may players have the tied, highest ranking hands, the pot, less any levy, may be split equally or carried over to the next hand.

After the pot aspect of the game has been resolved, each player's hand is examined to determine if the player has a hand ranking which corresponds to a schedule of winning Poker hands. For example, each player's hand may be compared to the following schedule to determine if the player is entitled to a corresponding prize:

TABLE 3

| | |
|---|---|
| Royal Flush | 200 to 1 |
| Straight Flush | 25 to 1 |
| 4-Of-A-Kind | 12 to 1 |
| Full House | 5 to 1 |
| Flush | 3 to 1 |
| Straight | 2 to 1 |
| 3-Of-A-Kind | 1 to 1 |
| Two Pair | Push |

Other pay table schedules may be adopted. If a player, for example, had made a $10 ante wager and have a five card flush, they would be paid, regardless if they won, lost or did not participate in the pot aspect of the game, $30.

Sequence 2

This embodiment of the game is similar to that of Sequence 1, except that instead of three community cards, each player is dealt three cards face up. Thus there are no community or shared cards, and each player forms their hand from their own, individual hands dealt to them.

Sequence 3

This embodiment of the game is similar to that of Sequence 1. Each player is dealt three cards, two face up and one face down. Two community cards are dealt face up and thereafter, each player is dealt two additional cards, one face up and one face down.

Sequence 4

This sequence is like that of Sequence 3 except that the two community cards are dealt face down and, the dealer in one version may expose both cards simultaneously and in a second version each card is separately revealed and thereafter, each player is dealt two additional cards, one face up and one face down.

Sequence 5

This sequence is like that of sequence 3 except that instead of community cards, each player is dealt those two cards face up. That is, the player is dealt three initial cards, two face up and one face down, then is dealt two cards face up and finally is dealt two more cards, one face up and the other face down. The players do not share any community cards.

Regardless of the sequence of the dealing of cards, each player is provided at least one opportunity to raise the pot. In one embodiment of the method of the invention, the players have the option of participating in the outcome aspects of the game (aside from the pot) by making an ante wager and, having examined their first cards, have the option to increase, e.g. double, their ante wager, provided such bet is equal to their initial ante wager. In a second embodiment, irrespective of the sequence of the dealing of the cards, the players must make a mandatory ante bet to participate in the outcome aspects of the game and having examined their first cards have the option to double their ante bet, provided such bet is equal in value to their initial wager.

Jackpot

Additionally, the game may be provided with a jackpot component funded by either a levy on the pot or by separate wagers made by the players. The jackpot is progressive, that is, the contributions such as a percentage of each pot or jackpot side wager continues to grow the jackpot until it is won. The jackpot may be initially funded at some "seed" amount to elicit interest in the jackpot.

According to one aspect, to win the jackpot the player must assemble one or more selected Poker hands, e.g. Royal Flush, Straight Flush, etc.; and providing a jackpot pay table paying at least a portion to a player obtaining the designated jackpot outcome. Those players that qualify as winners are paid out according to the current jackpot pay-table. Co-winners share the jackpot as an aggregate.

The jackpot can also be fixed.

Bad Beat Jackpot/Big Beat Jackpot

A further embodiment of the present invention, wherein a progressive or fixed jackpot is a feature of the game, is so structured that primary and secondary portions of the jackpot are awarded based upon the final hands held by two or more players. In one aspect, a bad beat jackpot, when a first wins the pot with a designated hand defeating another player with a different designated hand, the defeated player is awarded the primary jackpot portion, e.g. 50% and the winning player receives 25% with another portion, e.g. the remaining 25% of the jackpot awarded to the other players at the table as an envy bonus. For example, if a first player has a final hand of at least a full house of Aces over tens and loses the pot to another, second player, the first player would be awarded the first portion of the jackpot and the second player would be awarded the secondary jackpot in addition to winning the pot. The awarding of the bad beat jackpots occurs in addition to the awarding of the pot and any winning outcome.

In another embodiment, given the example above, the winning, second player would be awarded the primary jackpot with the losing player awarded the secondary jackpot. This is referred to herein as the big beat jackpot and requires the winning player to one of a schedule of pot winning hands and the second highest ranking hand to have one of a schedule of hands. That is, for example, the winning player may be required to have a four-of-a-kind with the second highest ranking hand being a full house.

No Levy

In the foregoing game, to make hosting of the game profitable, the house typically exacts a levy on the pot. To avoid the aspects of exacting a levy, the following method may be employed.

For those dealing sequences described above which include community cards, if the community cards have a predetermined constituency, the pot is won by the house without further action by the players. For example, if upon dealing the community cards, the first two community cards include an Ace and a King, the house would win the pot. It is believed that this feature provides approximately a 1.2% house advantage and sufficient profit to pay for hosting of the game. Other and more house winning combinations may be used. The house winning combinations could apply to the non-dealt cards, i.e. certain of the remaining cards in the deck after each player receives his individual and/or community cards in games that use community cards. Examples of house winning combinations that apply either to the community cards or the non-dealt cards are:

a. any two out of three community or non-dealt cards that include an Ace and King, giving the house about a 3.4% advantage;

b. the first two community or non-dealt cards include an Ace and a King or a Queen, giving the house an advantage of 2.4%;

c. the first two community cards or non-dealt cards include an Ace and a King, giving the house an advantage of about 1.2%;

d. the first two community cards or non-dealt cards comprise a King or higher giving the house an advantage of 2.1% e. the first two community cards or non-dealt cards comprise a three or lower, i.e. 2-2, 2-3 or 3-3, giving the house an advantage of about 2.1%; and f. the first two community cards or non-dealt cards are two of the same specified suit, e.g. two spades, giving the house an advantage of about 5.9%.

When the above method of the house winning the pot or a proportion thereof is employed, the house need not calculate and exact a levy upon the pot. Another advantage is that the speed of play of the game is increased The method of the present invention can be applied to games where there are no community cards. In the well known game of Pai Gow Poker, players assemble two Poker hands from their seven cards, a five card high hand and a lower ranking two card low hand. The players compete against the dealer's likewise assembled two Poker hands. The casino has a small edge over the players. To compensate for this near equity, the casino levies a 5% commission on all winning player hands. The imposition and administration of a levy slows the game down. The application of a method whereby the house wins all "pushes" (ties) in Pai Gow (i.e. in those situations where the players neither win nor lose) based upon either the dealer's first two dealt or exposed cards or the first two non-dealt cards comprising a predetermined combination will speed up the game and generate sufficient profit for the casino to dispense with the need to exact a levy on winnings. That is, in the event of a push and the dealer's exposed cards or the first two exposed cards comprise a predetermined card or combination, e.g. an Ace-King, the dealer would win the pushes. This feature can be used regardless of whether there is a pot component for the game. In addition where a pot is a feature of the Pai Gow Poker game, the same method described above can be employed to generate a profit on the pot component.

The casino cardroom game of Seven Card Stud Poker does not have community cards as a feature of the game. To dispense with the casino practice of exacting a levy on each pot for hosting the game and to provide a profit, the method of the present invention where the house occasionally wins the pot or a portion of the pot can be used. The house winning combinations a.–.f above can apply to the non-dealt cards for Seven card Stud.

As is the case with various forms of method of the present invention, casino cardroom games such as Texas Hold'em and Omaha both employ community cards as features. The house winning combinations described above can be used in these games as well to dispense with the need to exact a levy.

The method of the present invention coupled with a paytable would transform casino cardroom games such as Texas Hold'em, Omaha and Seven Card Stud and other cardroom games into Banker games. Casinos would now profit on both the pot component and the outcome (pay table) component. Players will be rewarded for skillful play based on challenging their opponents by raising the stakes in the pot, bluffing and by using optimal strategy to improve their hands. At present a cardroom player may end up with a high ranking hand, for example, a straight flush and win only a small pot. The application of a pay table to the cardroom game would reward the player with a high ranking hand in that he might win a small pot but would receive a substantial win according to the pay table.

The method, of the present invention can be adapted and played on a video game machine device in various forms and would embrace traditional cardroom games as described above and can be played as either a live or virtual game over the Internet.

According to the video version, the player would make the ante and pot wagers whereupon the cards would be dealt in any one of the above described sequences with the notable difference that the machine would also display a house or casino hand against which the player plays. The player may raise the pot wager and ante bet wager which the casino or virtual hand would see. Both aspects of he pot and outcome (ante) wagers would be resolved as described above. Jackpots may be provided for obtaining certain outcomes, for a bad beat or for a big beat as described above.

The method of the present invention can also be played on a multi-station video version where a number of players compete, either against one another for the pot and individually against a pay table, or where the players compete against themselves and a dealer.

In an internet version, players would be linked through the Internet to a site hosting the game. Either in a live or virtual format, the cards would be dealt and wagers made according to any one of the above game dealing sequences.

It is to be understood that the present invention is subject to many modifications and changes without departing form the spirit and scope of the appended claims.

I claim:

1. A method for playing a casino game between a plurality of players using playing cards comprising:

the players making a pot wager and a first outcome wager, all pot wagers aggregated to form a pot;

presenting cards to each player for a seven card hand according to any one of the following grouped game dealing sequences, 1. (a) 2 cards face up, one card face down to each player,
   (b) 3 community cards face up to be shared by all players, and
   (c) 1 card to each player face down,
2. (a) 2 cards face down, 1 card face up to each player,
   (b) 3 cards face up to each player, and
   (c) 1 card face down to each player,
3. (a) 2 cards face down, 1 card face up to each player,
   (b) 2 community cards face up to be shared by all players, and
   (c) 1 card face up, 1 card face down to each player,
4. (a) 2 cards face down, one card face up to each player,
   (b) 2 community cards face down to be shared by all players, said community cards revealed during play, and
   (c) 1 card face up and one card face down to each player,
5. (a) 2 cards face down, 1 card face up to each player,
   (b) 2 cards face up to each player, and
   (c) 1 card face up, 1 card face down to each player, each player's final hand determined by the highest ranking five card hand according to the rules of Poker;

designating at least at least one community card holding as a losing holding whereby ay least portion of the pot is won by the casino;

each player at least after the presentment of the first group of cards of the selected dealing sequence exercising the option of raising their pot wager, if any one player raises, each other player must match the raise, any player who declines to match disqualified from winning the pot;

at least one player after receiving his first group of cards optionally doubling their outcome wager;

comparing the rankings of the players hands, the player with the highest ranking final hand declared the winner of the pot; and assessing the ranking of each player's final hand and paying the player or collecting the outcome wagers based upon comparison of the players final hand outcome to a predetermined schedule of winning outcomes.

2. The method of claim 1 further including the casino hosting the game exacting a levy on the pot as payment.

3. The method of claim 1 including allocating a portion of the pot to form a jackpot, designating selected outcomes as jackpot outcomes and awarding the jackpot to at least one player participating on the jackpot outcome.

4. The method of claim 3 including awarding the player a primary jackpot portion if a player has a final hand outcome of a first preselected ranking and a secondary jackpot portion to another player in that round of play has a preselected hand of a lower ranking.

5. The method of claim 1 including providing a schedule of winning outcomes and payoffs according to Table 1,

TABLE 1

| | |
|---|---|
| Royal Flush | 250 to 1 |
| Straight Flush | 100 to 1 |
| 4-Of-A-Kind | 25 to 1 |
| Full House | 9 to 1 |
| Flush | 7 to 1 |
| Straight | 5 to 1 |
| 3-Of-A-Kind | 3 to 1 |

TABLE 1-continued

| | |
|---|---|
| Two Pair | 2 to 1 |
| Jacks or better | Push |

6. A method for playing a casino game between a plurality of players using playing cards comprising:

the players making a pot wager and a first outcome wager, all pot wagers aggregated to form a pot;

presenting cards to each player for a seven card hand according to any one of the following grouped game dealing sequences, 1. (a) 2 cards face up, one card face down to each player,
   (b) 3 community cards face up to be shared by all players, and
   (c) 1 card to each player face down,
2. (a) 2 cards face down, 1 card face up to each player,
   (b) 3 cards face up to each player, and
   (c) 1 card face down to each player,
3. (a) 2 cards face down, 1 card face up to each player,
   (b) 2 community cards face up to be shared by all players, and
   (c) 1 card face up, 1 card face down to each player,
4. (a) 2 cards face down, one card face up to each player,
   (b) 2 community cards face down to be shared by all players, said community cards revealed during play, and
   (c) 1 card face up and one card face down to each player,
5. (a) 2 cards face down, 1 card face up to each player,
   (b) 2 cards face up to each player, and
   (c) 1 card face up, 1 card face down to each player, each player's final hand determined by the highest ranking five card hand according to the rules of Poker;

designating at least one non-dealt holding as a losing holding whereby at least a portion of the pot is won by the casino;

each player at least after the presentment of the first group of cards of the selected dealing sequence exercising the option of raising their pot wager, if any one player raises, each other player must match the raise, any player who declines to match disqualified from winning the pot;

at least one player after receiving his first group of cards optionally doubling their outcome wager;

comparing the rankings of the players hands, the player with the highest ranking final hand declared the winner of the pot; and assessing the ranking of each player's final hand and paying the player or collecting the outcome wagers based upon comparison of the players final hand outcome to a predetermined schedule of winning outcomes.

7. A method for playing a casino game between a plurality of players using playing cards comprising:

the players making a pot wager and a first outcome wager, all pot wagers aggregated to form a pot;

presenting cards to each player for a seven card hand according to any one of the following grouped game dealing sequences, 1. (a) 2 cards face up, one card face down to each player,
   (b) 3 community cards face up to be shared by all players, and
   (c) 1 card to each player face down,
2. (a) 2 cards face down, 1 card face up to each player,
   (b) 3 cards face up to each player, and
   (c) 1 card face down to each player,
3. (a) 2 cards face down, 1 card face up to each player,
   (b) 2 community cards face up to be shared by all players, and
   (c) 1 card face up, 1 card face down to each player,
4. (a) 2 cards face down, one card face up to each player,
   (b) 2 community cards face down to be shared by all players, said community cards revealed during play, and
   (c) 1 card face up and one card face down to each player,
5. (a) 2 cards face down, 1 card face up to each player,
   (b) 2 cards face up to each player, and
   (c) 1 card face up, 1 card face down to each player, each player's final hand determined by the highest ranking five card hand according to the rules of Poker;

including a dealer's hand, said player's final hands are compared to the dealers's and designating one of a predetermined holding of the dealer's hand as a losing holding whereby at least a portion of the pot is won by the casino;

each player at least after the presentment of the first group of cards of the selected dealing sequence exercising the option of raising their pot wager, if any one player raises, each other player must match the raise, any player who declines to match disqualified from winning the pot;

at least one player after receiving his first group of cards optionally doubling their outcome wager;

comparing the rankings of the players hands, the player with the highest ranking final hand declared the winner of the pot; and assessing the ranking of each player's final hand and paying the player or collecting the outcome wagers based upon comparison of the players final hand outcome to a predetermined schedule of winning outcomes.

8. A method for playing a casino game between a plurality of players using a deck of playing cards comprising:

the players making a pot wager and a first outcome wager, all pot wagers aggregated to form a pot;

presenting cards to each player in at least a first group and then a second group for at least a seven card hand, each player's final hand determined by the highest ranking five card hand according to the rules of Poker;

each player after presentment of the first group of cards exercising the option of raising their pot wager, if any one player raises, each other player must match the raise, any player who declines to match disqualified from winning the pot;

at least one player after receiving his first group of cards doubling their outcome wager;

comparing the rankings of the players hands, the player with the highest ranking final hand declared the winner of the pot;

assessing the ranking of each player's final hand and paying the player or collecting the outcome wagers based upon comparison of the players final hand outcome to a predetermined schedule of winning outcomes; and if at least one non-dealt card remaining in the deck constitutes a predetermined holding, at least a portion of the pot won by the casino.

9. A method for playing a casino game between a plurality of players using a deck of playing cards comprising:

the players making a pot wager and a first outcome wager, all pot wagers aggregated to form a pot;

presenting cards to each player in at least a first group and a group of community cards to be shared by the players for at least a seven card hand, each player's final hand determined by the highest ranking five card hand according to the rules of Poker;

each player after presentment of the first group of cards exercising the option of raising their pot wager, if any one player raises, each other player must match the raise, any player who declines to match disqualified from winning the pot;

at least one player after receiving his first group of cards doubling their outcome wager;

comparing the rankings of the players hands, the player with the highest ranking final hand declared the winner of the pot;

assessing the ranking of each player's final hand and paying the player or collecting the outcome wagers based upon comparison of the players final hand outcome to a predetermined schedule of winning outcomes; and if at least one community card constitutes a predetermined holding, at least a portion of the pot won by the casino.

10. A method for playing a casino game between a plurality of players using a deck of playing cards comprising:

presenting cards to each player in at least a first group and then a second group for at least a seven card hand, each player's final hand determined by the highest ranking five card hand according to the rules of Poker;

the players making a pot wager and a first outcome wager, all pot wagers aggregated to form a pot;

each player exercising the option of raising their pot wager, if any one player raises, each other player must match the raise, any player who declines to match disqualified from winning the pot;

at least one player after receiving his first group of cards doubling their outcome wager;

comparing the rankings of the players hands, the player with the highest ranking final hand declared the winner of the pot;

assessing the ranking of each player's final hand and paying the player or collecting the outcome wagers based upon comparison of the players final hand outcome to a predetermined schedule of winning outcomes; and if at least one non-dealt card remaining in the deck constitutes a predetermined holding, at least a portion of the wagers won by the casino.

* * * * *